US007750610B2

(12) United States Patent
Vorenkamp

(10) Patent No.: US 7,750,610 B2
(45) Date of Patent: Jul. 6, 2010

(54) VOLTAGE SUPPLY INTERFACE WITH CURRENT SENSITIVITY AND REDUCED SERIES RESISTANCE

(75) Inventor: Pieter Vorenkamp, Laguna Niguel, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

(21) Appl. No.: 12/320,195

(22) Filed: Jan. 21, 2009

(65) Prior Publication Data

US 2009/0153121 A1 Jun. 18, 2009

Related U.S. Application Data

(63) Continuation of application No. 11/330,327, filed on Jan. 12, 2006, now Pat. No. 7,498,779.

(60) Provisional application No. 60/647,458, filed on Jan. 28, 2005.

(51) Int. Cl.
*G05F 1/00* (2006.01)

(52) U.S. Cl. ..... 323/272; 323/283

(58) Field of Classification Search ..... 323/272, 323/283, 282

See application file for complete search history.

(56) References Cited

U.S. PATENT DOCUMENTS

| | | | | |
|---|---|---|---|---|
| 4,616,142 | A * | 10/1986 | Upadhyay et al. | 327/405 |
| 5,119,014 | A * | 6/1992 | Kronberg | 323/267 |
| 6,249,111 | B1 * | 6/2001 | Nguyen | 323/282 |
| 6,362,606 | B1 * | 3/2002 | Dupuis et al. | 323/272 |
| 6,563,293 | B2 * | 5/2003 | Marino et al. | 323/272 |
| 6,621,255 | B2 * | 9/2003 | Telefus | 323/272 |
| 6,841,896 | B2 * | 1/2005 | Chiou et al. | 307/28 |
| 6,930,473 | B2 * | 8/2005 | Elbanhawy | 323/282 |
| 7,091,708 | B2 * | 8/2006 | Moussaoui | 323/272 |
| 7,253,540 | B1 * | 8/2007 | Thalheim et al. | 307/115 |

* cited by examiner

*Primary Examiner*—Shawn Riley
(74) *Attorney, Agent, or Firm*—Sterne, Kessler, Goldstein & Fox P.L.L.C.

(57) ABSTRACT

A voltage supply interface provides both coarse and fine current control with reduced series resistance. The voltage supply interface has a segmented switch having N component switches that are digitally controlled. The voltage supply interface replaces a conventional sense resistor with a calibration circuit that has a replica switch that is a replica of the N component switches. The calibration circuit includes a reference current $I_{REF}$ that is sourced through the replica switch. A feedback amplifier forces a common voltage drop across the replica switch and the n-of-N activated component switches so that the cumulative current draw through the segmented switch is $n \cdot I_{REF}$. The current control of the voltage interface can be coarsely tuned by activating or deactivating component switches, and can be finely tuned by adjusting the reference current. The current sense resistor is eliminated so that the overall series resistance is lower.

20 Claims, 5 Drawing Sheets

VOLTAGE SUPPLY INTERFACE WITH CURRENT SENSITIVITY AND REDUCED SERIES RESISTANCE

CROSS REFERENCE TO RELATED APPLICATIONS

This application is a continuation of U.S. application Ser. No. 11/330,327, filed Jan. 12, 2006, now pending, which claims the benefit of U.S. Provisional Patent Application No. 60/647,458, filed Jan. 28, 2005, each of which is incorporated herein by reference in its entirety.

BACKGROUND OF THE INVENTION

1. Field of the Invention

The present invention generally relates to voltage supply interfaces. More specifically, the present invention provides a voltage supply interface having more accurate control and reduced series resistance.

2. Background Art

A voltage supply interface provides voltage and current to a next stage circuit device from a primary voltage supply. The voltage supply interface uses a switch to slowly power on the next stage circuit device when the next state circuit device is coupled to the primary voltage supply.

The voltage supply interface monitors the current supplied to the next stage circuit device to control the power supplied to the next stage circuit device. A conventional voltage supply interface uses a sense resistor that is in series with the next stage device to monitor the current. The sense resistor is required to be large to provide accurate current monitoring. A resulting large voltage drop across the sense resistor, however, reduces the power supplied to the next stage device. Further, supplying an adjustable current is difficult with the use of a single, inflexible switch.

Therefore, there exists a need for a voltage supply interface that provides more accurate control of the current supplied to the next stage device that minimizes or eliminates the power loss from the required sense resistor.

BRIEF SUMMARY OF THE INVENTION

A voltage supply interface provides both coarse and fine current control and reduced series resistance. The voltage supply interface has a segmented switch having N component switches that are digitally controlled. The voltage supply interface replaces a conventional sense resistor with a calibration circuit that has a replica switch that is a replica of the N component switches. The calibration circuit includes a reference current $I_{REF}$ that is sourced through the replica switch. A voltage comparator forces a common voltage drop across the replica switch and the n-of-N activated component switches so that the cumulative current draw through the segmented switch is $n \cdot I_{REF}$. The current control of the voltage interface can be coarsely tuned by activating or deactivating component switches, and can be finely tuned by adjusting the reference current. The current sense resistor is eliminated so that the overall series resistance is lower.

In one embodiment of the invention, there is provided a voltage supply interface including a segmented switch, a calibration circuit and a digital controller. The segmented switch includes N parallel component switches. The calibration circuit is coupled in parallel with the segmented switch and provides a reference current $I_{REF}$. The digital controller is coupled between the calibration circuit and the segmented switch and activates n of the N parallel component switches.

A common voltage drop across the segmented switch and the replica switch causes a cumulative current substantially equal to $n \cdot I_{REF}$ to flow through the segmented switch. The digital controller activates and deactivates the parallel component switches based on the common voltage drop. The calibration circuit includes a current source and a replica switch biased by the current source. The current source is adjusted to provide a fine-tuning of the cumulative current. The calibration circuit further includes a voltage comparator configured to provide the common voltage drop across the segmented switch and the replica switch. An output of the voltage comparator is coupled to the digital controller. The N parallel component switches and the replica switch are substantially the same size.

In another embodiment of the invention, there is provided a method for regulating a current provided to a next stage circuit device from a primary voltage supply. A replica switch is biased with a reference current $I_{REF}$. A common voltage drop is forced across the replica switch and a segmented switch that includes N parallel component switches. n of the N parallel component switches are activated based on the common voltage drop, thereby causing a cumulative current flowing through the segmented switch to be substantially equal to $n \cdot I_{REF}$. A voltage comparator forces the common voltage drop and provides an indication of the common voltage drop to a digital controller. The digital controller activates and/or deactivates parallel component switches based on the common voltage drop to provide coarse control of the cumulative current. The reference current is adjusted to provide fine-tuning control of the cumulative current.

In another embodiment of the invention, there is provided voltage supply interface including a replica switch, a segmented switch, a voltage comparator and a digital controller. The replica switch is biased with a reference current $I_{REF}$. The segmented switch is coupled in parallel to the replica switch and includes a plurality of parallel component switches. The voltage comparator provides a common voltage drop across the segmented switch and the replica switch. The digital controller activates zero or more of the parallel component switches based on the common voltage drop. A cumulative current flow through the segmented switch is substantially equal to a sum of the individual currents flowing through the zero or more activated parallel component switches.

Additional features and advantages of the invention will be set forth in the description that follows, and in part will be apparent from the description, or may be learned by practice of the invention. The advantages of the invention will be realized and attained by the structure and particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS/FIGURES

The accompanying drawings illustrate the present invention and, together with the description, further serve to explain the principles of the invention and to enable one skilled in the pertinent art to make and use the invention.

Figure 5:
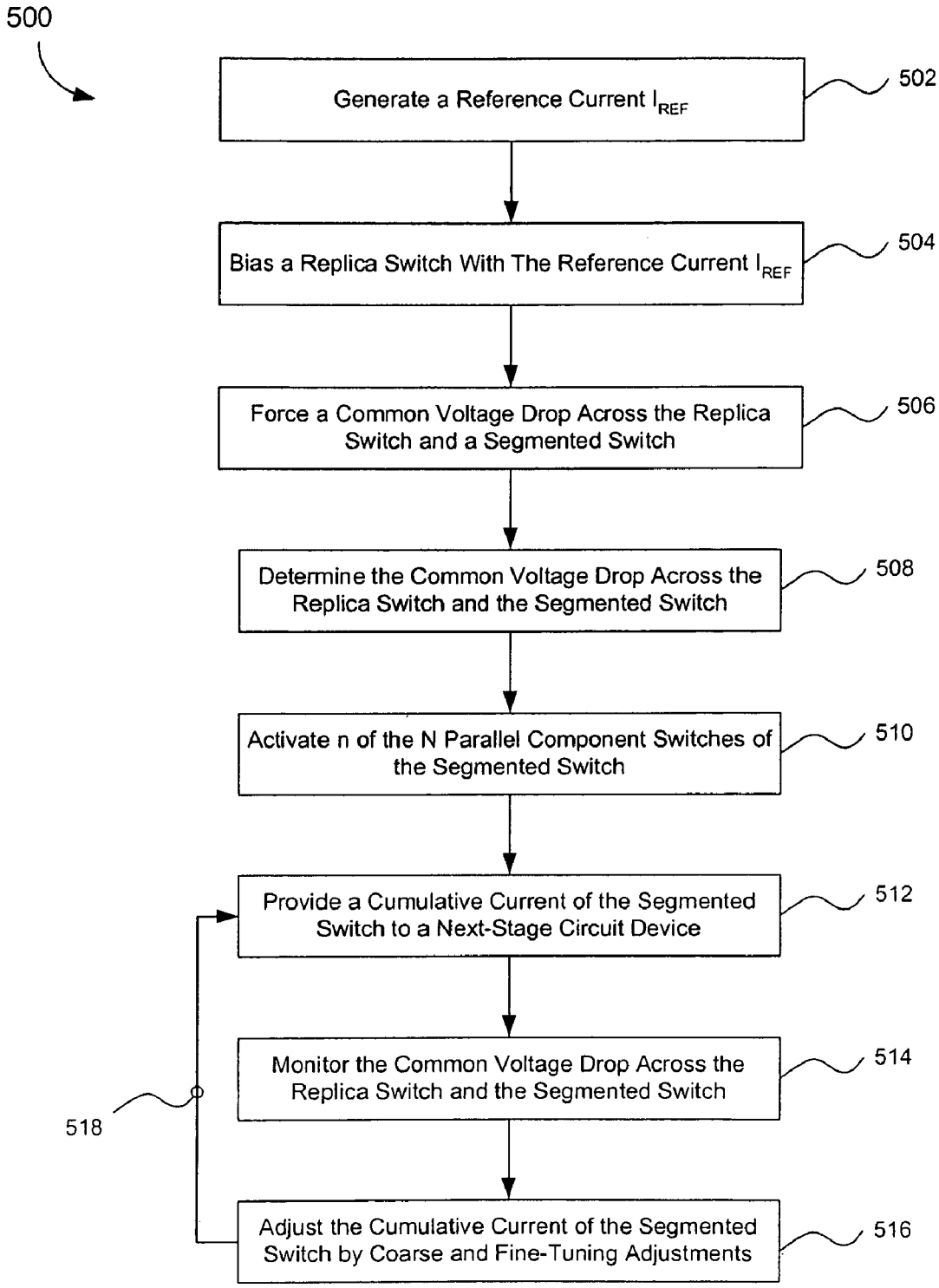

FIG. 5 provides a flowchart of a method for regulating current flow to a next stage circuit device according to the present invention

DETAILED DESCRIPTION OF THE INVENTION

Figure 1:
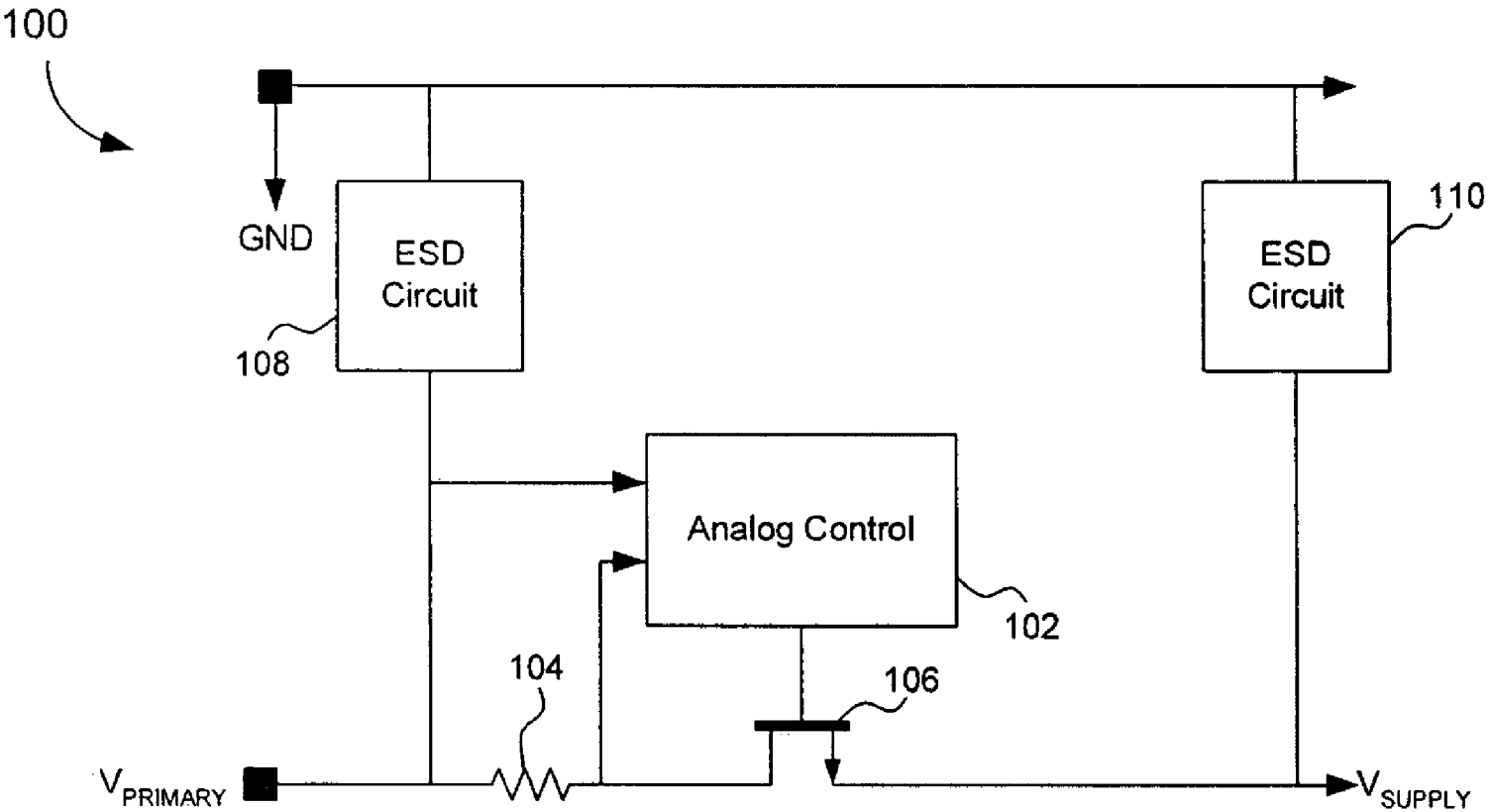
Conventional Art FIG. 1
FIG. 1 illustrates a conventional voltage supply interface.

FIG. 1 illustrates a conventional voltage supply interface 100. The conventional voltage supply interface 100 is coupled to a primary voltage supply $V_{PRIMARY}$. The conventional voltage supply interface 100 provides a voltage $V_{SUPPLY}$ to a next stage circuit device. The conventional voltage supply interface 100 uses an analog control 102, a sense resistor 104 and a switch 106 to provide power to the next stage circuit device. The switch 106 is typically implemented with a Field Effect Transistor (FET), but this invention is not limited to such process technology only. Other process technologies could be used as will be recognized by those skilled in the arts.

The conventional voltage supply interface 100 often incorporates Electro-Static Discharge (ESD) protection. As shown in FIG. 1, the conventional voltage supply interface 100 includes an ESD circuit 108 coupled between $V_{PRIMARY}$ and a ground potential (GND). The ESD circuit 108 protects the analog control 102 and the switch 106. The conventional voltage supply interface 100 also includes an ESD circuit 110 coupled between $V_{SUPPLY}$ and GND. The ESD circuit 110 protects the next stage circuit device coupled to $V_{SUPPLY}$.

The sense resistor 104 is coupled in series with the switch 106. The analog control 102 monitors the voltage drop across the sense resistor 104. The resistance of the sense resistor 104 is a known value and allows the analog control 102 to accurately measure the current flowing through the switch 106. The analog control 102 adjusts the current supplied by $V_{SUPPLY}$ by tuning the conductivity of the switch 106 based on the voltage measured across the sense resistor 104.

The analog control 102 slowly turns on the switch 106 when a next stage circuit device is coupled to $V_{SUPPLY}$. By slowly turning on the switch 106, the analog control 102 slowly turns on the next stage circuit device. As the next stage circuit device is powered up, and once the next stage circuit device is fully turned on, the analog control 102 and the switch 106 behave as an electronic fuse. That is, the analog control 102 monitors the current supplied to the next stage circuit device and cuts off the switch 106 if the current exceeds a maximum level.

Typically, the current flow through the sense resistor 104 is small. The resistance of the sense resistor 104 is therefore required to be large for the analog control 102 to accurately measure current. The total resistance between $V_{PRIMARY}$ and $V_{SUPPLY}$ is determined by the sum of the resistance of the sense resistor 104 and the on-resistance of the switch 106. This combined series resistance decreases the voltage supplied to the next stage circuit device by $V_{SUPPLY}$. Essentially, the voltage drop across the switch 106 and the sense resistor 104 translates into wasted power. Therefore, it is desired to keep the sum of the resistance of the sense resistor 104 and the on-resistance of the switch 106 as small as possible.

To keep the sum of the resistance of the sense resistor 104 and the on-resistance of the switch 106 small requires making the on-resistance of the switch as small as possible. The on-resistance of the switch 106 must be small because the resistance of the sense resistor 104 must be relatively large for accurate current monitoring purposes. The on-resistance of the switch 106 is reduced by making the FET size large. However, this increases die size, and will increase the parasitic capacitances of the switch 106.

Figure 2:
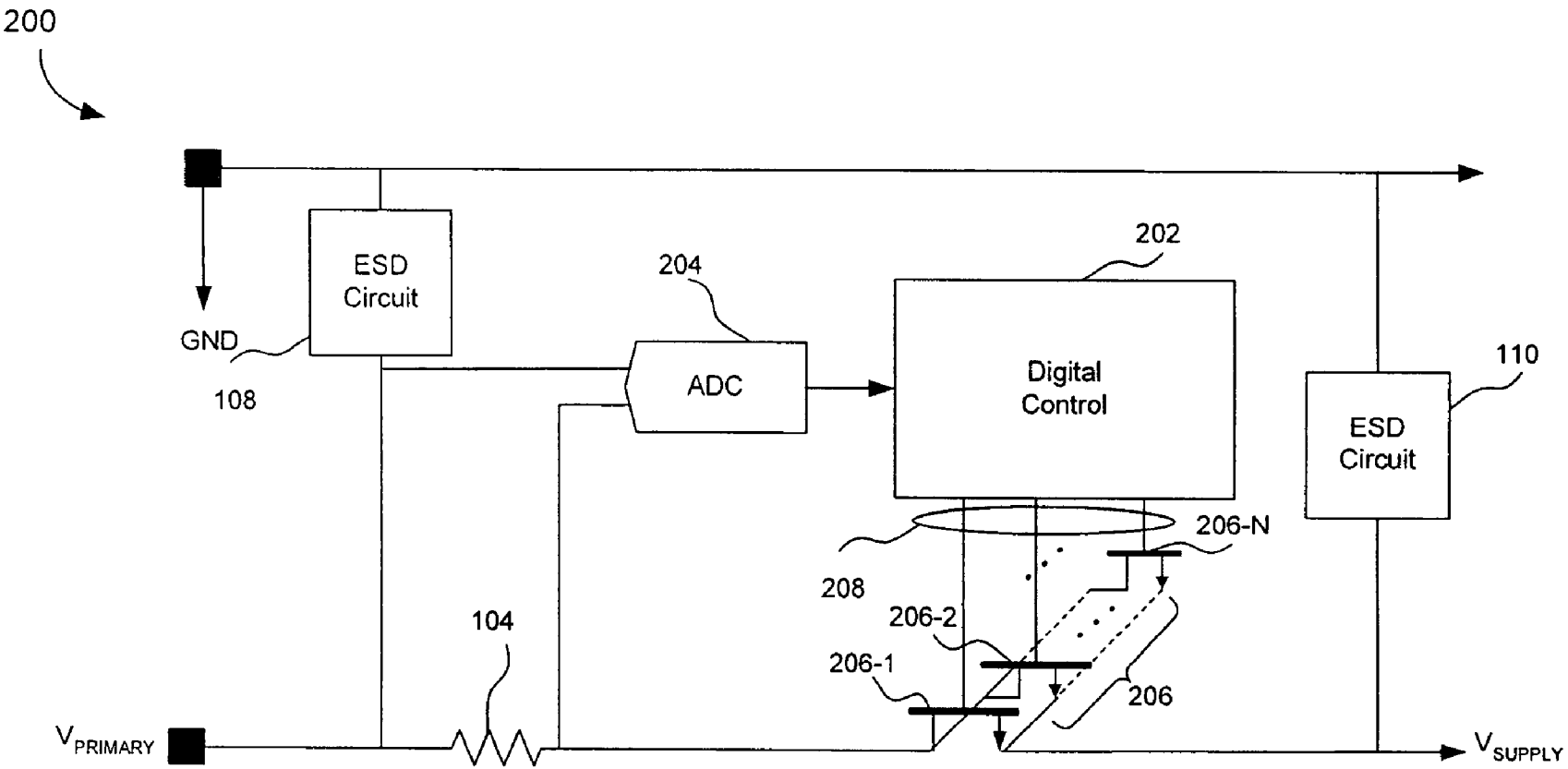
FIG. 2 illustrates a digital voltage supply interface.

FIG. 2 illustrates a digital voltage supply interface 200. The digital voltage supply interface 200 includes a digital control 202, an analog-to-digital converter (ADC) 204, the sense resistor 104 and a segmented switch 206. The segmented switch 206 is comprised of N parallel switches (shown as switches 206-1, 206-2 . . . 206-N). Each of the N parallel switches can be implemented with FETs that are of the same size. In another embodiment, the FETs composing the N-parallel switches are sized differently from each other. For example, the size of the FETs comprising the N-parallel switches could be binary weighted relative to each other, or some other sizing scheme could be used. In other words, different size ratios of the N parallel switches are not to be excluded from this invention (e.g. binary weighted switch sizing).

The ADC 204 measures the voltage drop across the sense resistor 104 and provides a digital indication of the voltage drop to the digital control 202. The digital control 202, based on the measured voltage drop across the sense resistor 104, turns on or turns off a portion of the N parallel FETs to adjust the current flow to $V_{SUPPLY}$. Specifically, the gates of the N parallel FETs are driven by an N-bit wide control word 208 issued by the digital control 202 to adjust the current flow.

The on-resistance of the segmented switch 206 is determined by the parallel combination of the on-resistances of the FETs turned on by the digital control 202. More current flows through the segmented switch 206 as more of the component FETs are switched on. Less current flows through the segmented switch 206 as more of the component FETs are switched off. In this way, the parallel combination of the N FETs that make up the segmented switch 206 provides more accurate control and regulation of the current supplied to the next stage circuit device than provided by the switch 106 of the conventional voltage supply interface 100.

Figure 3:
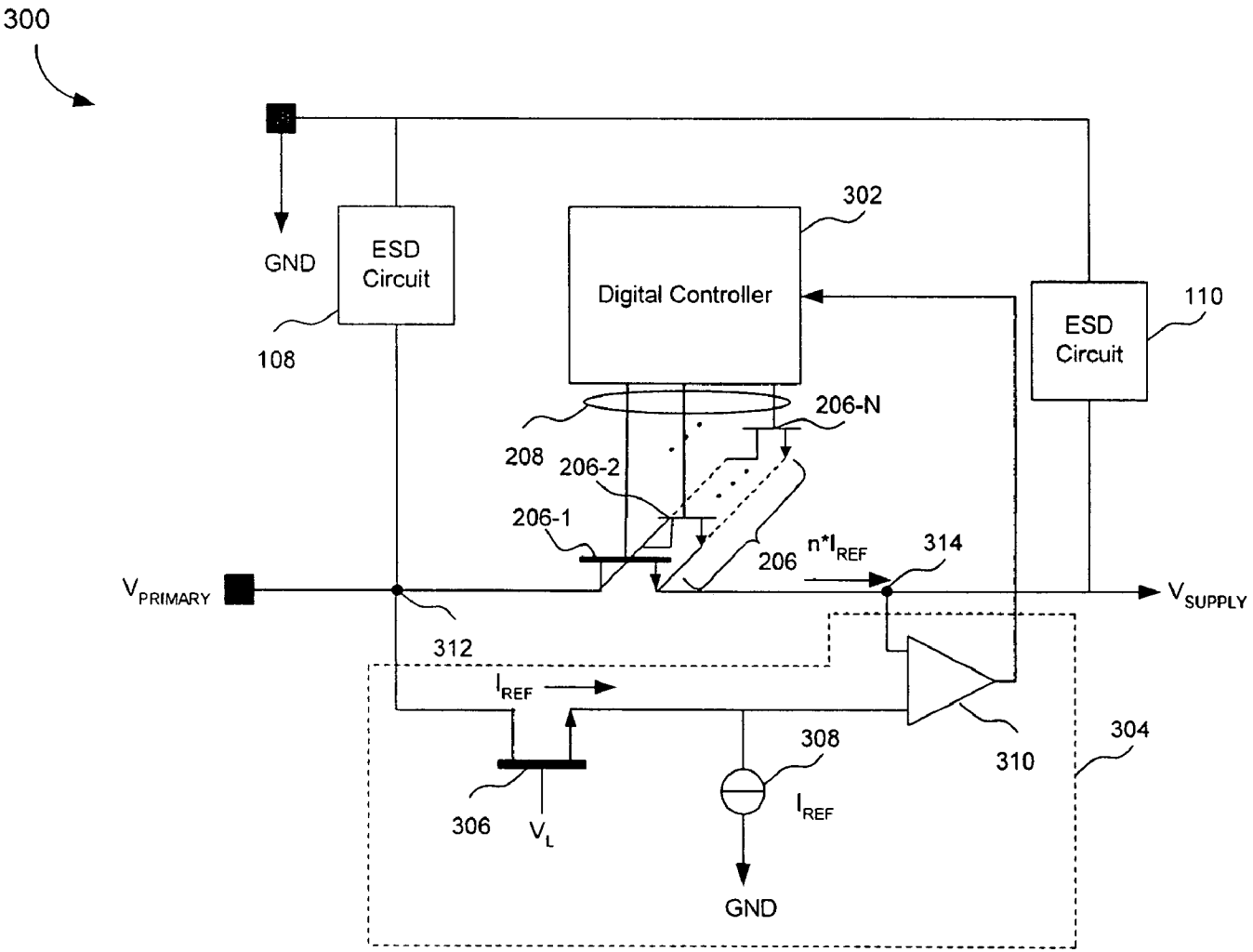
FIG. 3 illustrates a calibrated digital voltage supply interface having lowered series resistance and coarse current adjustment capability according to the present invention.

FIG. 3 illustrates a calibrated digital voltage supply interface 300 of the present invention. The calibrated digital voltage supply interface 300 includes the segmented switch 206 composed of N parallel FETs. The segmented switch 206 is connected to a digital controller 302. The calibrated digital voltage supply interface 300 also includes a calibration circuit 304. The calibration circuit 304 includes a replica switch 306. The replica switch 306 is implemented with a FET that is of the same size as each of the N parallel FETs that comprise the segmented switch 206. The replica switch is biased with a low bias voltage $V_L$ (and therefore the replica switch is turned "ON"). The replica switch 306 is connected to $V_{PRIMARY}$ and the segmented switch 206 at a node 312.

As further shown in FIG. 3, the calibration circuit 304 includes a current source 308. The current source 308 provides a reference current $I_{REF}$. The calibration circuit 304 also includes a voltage comparator 310 that could be implemented as a different amplifier. A first input of the voltage comparator 310 is coupled to both the current source 308 and the replica switch 306. A second input of the voltage comparator 310 is connected to a node 314. An output of the voltage comparator 310 is connected to the digital controller 302.

During operation, the current flowing through the replica switch 306 is equal to $I_{REF}$. The voltage comparator 310 forces the voltage drop across the replica switch 306 to be equal to the voltage drop across the segmented switch 206. At any one time, n of the N parallel FETs within the segmented switch 206 are turned on. Therefore, the voltage drop across the one FET that makes up the replica switch 306 is equal to the voltage drop across the n parallel FETs that are turned on within the segmented switch 206. This causes a cumulative current equal to $n \cdot I_{REF}$ to flow through the segmented switch 206 when the n parallel FETs are equal in size to each other, and to the replica switch 306. Alternatively, different cumulative current values for the segmented switch 206 can be created by sizing the parallel component switches to be different from each other, as was discussed above. For example, the parallel component switches can be sized so as to have a binary weighting relative to each other, so to produce corresponding binary weighted current increments. As such, each segmented switch can be broadly described as producing a corresponding individual current that is proportional to $I_{REF}$ (including fractions and multiples of $I_{REF}$), so that changes in $I_{REF}$ produce corresponding changes in individual parallel component currents of the segmented switch 206. In turn, a large current is supplied to the next stage circuit device coupled to the calibrated digital voltage supply interface 300.

The current that flows through the segmented switch 206 can be coarsely controlled by the digital controller 302. That is, the digital controller 302 can successively turn on or turn off the component FETs within the segment switch 206 in order to increase or decrease the current provided to the next stage circuit device. The current flow provided to the next stage device can vary between no current and a current equal to $N \cdot I_{REF}$. This range is subdivided or quantized into N equal increments of a current equal to $I_{REF}$.

Figure 4:
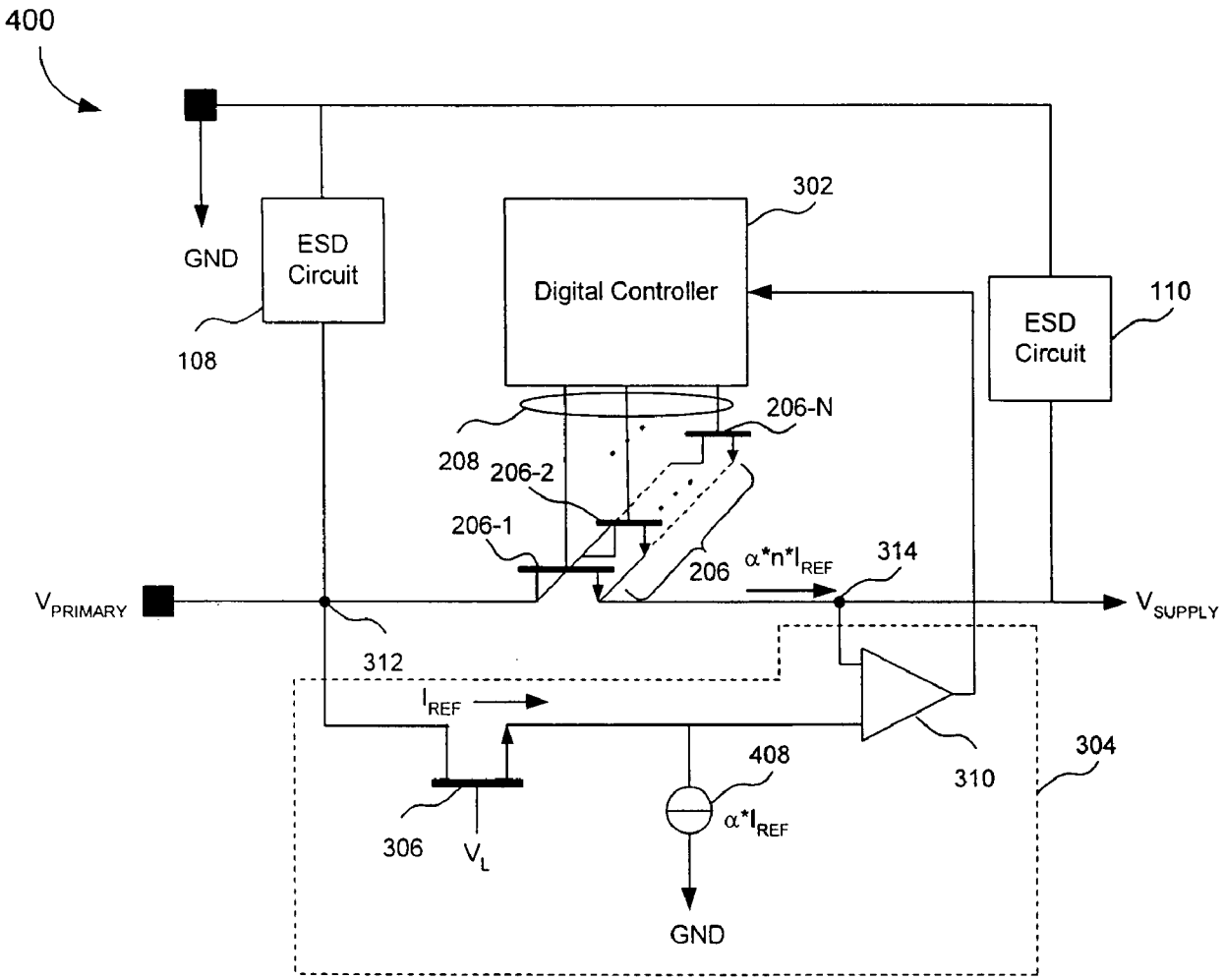
FIG. 4 illustrates a calibrated digital voltage supply interface having reduced series resistance and both fine and coarse current adjustment capability according to the present invention.

FIG. 4 illustrates a calibrated digital voltage supply interface 400 having both fine and coarse tuning capability according to the present invention. The calibrated digital voltage supply interface 400 includes an adjustable current source 408. For example, the adjustable current source 408 can be a programmable current source. The adjustable current source 408 can adjust the current supplied to the replica switch 306 and therefore the segmented switch 206. Specifically, the current $I_{REF}$ provided by the adjustable current source 408 can be adjusted by a factor $\alpha$.

Adjusting the current $I_{REF}$ by the factor $\alpha$ provides a fine-tuning adjustment of the current that is supplied to the next stage circuit device. Therefore, the calibrated digital voltage supply interface 400 provides coarse current adjustment by switching on component FETs within the segmented switch 206 and also provides fine current adjustment by adjusting the size of the reference current $I_{REF}$ supplied by the adjustable current source 408. Overall, a cumulative current equal to $\alpha \cdot n \cdot I_{REF}$ flows through the segmented switch 206.

Both the calibrated digital voltage supply interface 300 depicted in FIG. 3 and the calibrated digital voltage supply interface 400 depicted in FIG. 4 provide an overall lower series resistance. Specifically, the need for a large sense resistor for monitoring current flow has been eliminated. With the large sense resistor eliminated, the calibrated digital voltage supply interface 300 and calibrated digital voltage supply interface 400 can tolerate higher on-resistances from the component FETs within the segmented switch 206. In turn, these component FETs can be made smaller which reduces space requirements and parasitic capacitances. The accuracy of a conventional voltage supply interface is limited by the large sense resistor. With the calibrated digital voltage supply interface 300 and calibrated digital voltage supply interface 400, this limitation is removed and accuracy is now determined by the matching of the component FETs within the segment switch 206 and the FET within the replica switch 306.

FIG. 5 provides a flowchart 500 that illustrates operational steps corresponding to FIG. 4, for regulating current flow to a next stage circuit device by a voltage supply interface, according to the present invention. The invention is not limited to this operational description. Rather, it will be apparent to persons skilled in the relevant art(s) from the teachings herein that other operational control flows are within the scope and spirit of the present invention. In the following discussion, the steps in FIG. 5 are described.

At step 502, a reference current equal to $I_{REF}$ is generated by an adjustable current source.

At step 504, a replica switch is biased by the reference current $I_{REF}$.

At step 506, a voltage drop across a segmented switch is forced to be equal to a voltage drop across the replica switch.

At step 508, the common voltage drop across the replica switch and the segmented switch is determined.

At step 510, n of the N parallel component switches comprising the segmented switch are activated.

At step 512, a cumulative current equal to $n \cdot I_{REF}$ is provided to the next stage circuit device.

At step 514, the common voltage drop across the replica switch and the segmented switch is monitored.

At step 516, the cumulative current provided to the next stage device is adjusted. Coarse adjustments are made by either turning on or turning off parallel component switches of the component switch. Turning on additional parallel component switches coarsely increases the cumulative current flow through the segmented switch. Turning off additional parallel component switches coarsely decreases the cumulative current flow through the segmented switch. Fine-tuning adjustments are made by adjusting the reference current $I_{REF}$ provided by the adjustable current source. Specifically, the reference current $I_{REF}$ is adjusted by a factor $\alpha$ such that the cumulative current flow through the segmented switch is equal to $\alpha \cdot n \cdot I_{REF}$.

A voltage supply interface operating according to the flowchart 500 will provide this adjusted cumulative current to the next stage device, and will continue to monitor and adjust the cumulative current flow, as indicated by the repeat operation step 518.

CONCLUSION

While various embodiments of the present invention have been described above, it should be understood that they have been presented by way of example and not limitation. It will be apparent to one skilled in the pertinent art that various changes in form and detail can be made therein without departing from the spirit and scope of the invention. Therefore, the present invention should only be defined in accordance with the following claims and their equivalents.

What is claimed is:

1. A voltage supply interface, comprising:

a segmented switch comprising N parallel component switches, each of the N parallel component switches configured to be set in at least one of a closed state and an open state independent of a state of any other of the N parallel component switches; and a calibration circuit coupled in parallel with the segmented switch and having a current source configured to provide a reference current;

wherein the segmented switch and the calibration circuit are configured to have a common voltage drop so that a closed parallel component switch of the N parallel component switches conducts a current proportional to the reference current and contributes to a cumulative current that flows through the segmented switch.

2. The voltage supply interface of claim 1, further comprising a digital controller coupled between the calibration circuit and the segmented switch and configured to close n of the N parallel component switches.

3. The voltage supply interface of claim 2, wherein the digital controller is configured to close n of the N parallel component switches based on the common voltage drop of the segmented switch and the calibration circuit.

4. The voltage supply interface of claim 3, wherein a current substantially equal to the reference current is configured to flow through each of the n-closed parallel component switches.

5. The voltage supply interface of claim 1, wherein the segmented switch is coupled between a primary voltage supply and a next stage circuit device.

6. The voltage supply interface of claim 1, wherein the current source comprises a variable current source configured to adjust the cumulative current that flows through the segmented switch.

7. The voltage supply interface of claim 1, wherein the calibration circuit further comprises:

a replica switch configured to be biased by the reference current; and a voltage comparator configured to provide the common voltage drop of the replica switch and the segmented switch.

8. A method of regulating current flow, comprising:

forcing a common voltage drop across a replica switch and a segmented switch, wherein the segmented switch comprises N parallel component switches; and closing n of the N parallel component switches based on the common voltage drop so that each of the n-closed parallel component switches conducts a current proportional to a reference current and contributes to a cumulative current that flows through the segmented switch.

9. The method of claim 8, further comprising adjusting a variable current source to provide a fine-tuning adjustment of the cumulative current that flows through the segmented switch.

10. The method of claim 8, further comprising biasing the replica switch with the reference current.

11. The method of claim 8, wherein the replica switch is a same size as at least a switch of the N parallel component switches.

12. The method of claim 8, further comprising determining the common voltage drop across the replica switch and the segmented switch.

13. The method of claim 8, wherein the closing n of the N parallel component switches is controlled by a digital controller.

14. The method of claim 8, further comprising closing additional parallel component switches of the N parallel component switches to increase the cumulative current that flows though the segmented switch.

15. A voltage supply interface, comprising:

a replica switch configured to be biased by a reference current from a current source; and a segmented switch coupled in parallel with the replica switch and comprising a plurality of parallel component switches;

wherein:

the replica switch and the segmented switch are configured so that each of a voltage drop across the segmented switch and a voltage drop across the replica switch is equal to a common voltage drop;

the plurality of parallel component switches are configured to be individually switched based on the common voltage drop so that an individual current substantially equal to the reference current flows through each closed parallel component switch; and a cumulative current flow through the segmented switch is substantially equal to a sum of individual currents flowing through closed parallel component switches.

16. The voltage supply interface of claim 15, further comprising a voltage comparator configured to provide the common voltage drop across the segmented switch and the replica switch.

17. The voltage supply interface of claim 15, further comprising a digital controller configured to control the plurality of parallel component switches based on the common voltage drop so that the individual current substantially equal to the reference current flows through each closed parallel component switch.

18. The voltage supply interface of claim 17, wherein the current source is a part of a calibration circuit coupled in parallel with the segmented switch.

19. The voltage supply interface of claim 15, wherein the current source comprises a variable current source configured to adjust the cumulative current flow through the segmented switch.

20. The voltage supply interface of claim 15, wherein the calibration circuit further comprises a voltage comparator and a replica switch, wherein:

a first input of the voltage comparator is coupled to the current source and the replica switch;

a second input of the voltage comparator is coupled to an output of the segmented switch;

an output of the voltage comparator is coupled to the digital controller;

the voltage comparator is configured to force the common voltage drop between the segmented switch and the replica switch;

the voltage comparator is configured to provide an indication of the common voltage drop to the digital controller; and the digital controller is configured to close the n of the N parallel component switches based on the indication of the common voltage drop.

* * * * *

UNITED STATES PATENT AND TRADEMARK OFFICE

CERTIFICATE OF CORRECTION

PATENT NO. : 7,750,610 B2
APPLICATION NO. : 12/320195
DATED : July 6, 2010
INVENTOR(S) : Pieter Vorenkamp It is certified that error appears in the above-identified patent and that said Letters Patent is hereby corrected as shown below:

Column 7

Line 56, please replace “though” with --through--.

Signed and Sealed this

Seventh Day of September, 2010

David J. Kappos

David J. Kappos
*Director of the United States Patent and Trademark Office*